United States Patent [19]

Irwin

[11] Patent Number: 4,503,754

[45] Date of Patent: Mar. 12, 1985

[54] ROTARY CYLINDER ENGINES WITH PISTONS HAVING BALANCED LOADS

[76] Inventor: Everett F. Irwin, 430 Orangewood Dr., Dunedin, Fla. 33528

[21] Appl. No.: 616,237

[22] Filed: Jun. 1, 1984

[51] Int. Cl.[3] ..... F01B 13/06

[52] U.S. Cl. ..... 91/488; 91/493; 91/498; 91/490

[58] Field of Search ..... 91/472, 474, 487, 488, 91/490, 491, 493–495, 498; 417/273; 123/44 R, 44 E, 44 C

[56] References Cited

U.S. PATENT DOCUMENTS

| | | | |
|---|---|---|---|
| 1,358,504 | 11/1920 | Beijer | 91/498 |
| 1,932,892 | 10/1933 | Hele-Shaw et al. | 91/498 X |
| 1,990,660 | 2/1935 | McCann | 123/44 E |
| 2,045,330 | 6/1936 | MacMillin | 91/493 |
| 2,515,033 | 7/1950 | Connor | 91/498 X |
| 2,674,195 | 4/1954 | Aluja | 91/494 |
| 3,036,557 | 5/1962 | Kimsey | 91/490 X |
| 3,093,301 | 6/1963 | Mitchell | 417/273 |
| 3,168,007 | 2/1965 | Wiedmann | 91/487 |
| 3,492,948 | 2/1970 | Platt | 91/476 |
| 3,777,624 | 12/1973 | Dixon | 91/488 |
| 4,018,139 | 4/1977 | Landreau | 91/490 |
| 4,413,486 | 11/1983 | Irwin | 91/493 X |

FOREIGN PATENT DOCUMENTS 2313155 10/1973 Fed. Rep. of Germany ..... 91/491

*Primary Examiner*—William L. Freeh
*Assistant Examiner*—Paul F. Neils
*Attorney, Agent, or Firm*—Ronald E. Smith; Harold D. Shall

[57] ABSTRACT

A rotating cylinder engine having a stationary housing surrounding a rotating cylinder block which rotates unitarily but eccentrically with an output shaft. The housing rotatably mounting both the shaft and the cylinder block. The output shaft has cam flats cooperatively positioned with cylinders in the cylinder block; the cylinders having sealed outer ends. A piston is slideable in each cylinder with its inner end sealingly and slidingly engaging an associated cam flat. Fluid passages in said cam flats alternate from a source of pressured air and from an exhaust. The pistons have a central bore therein confluent with the fluid passages in the cam flats so that pressure can flow through the piston and react between the outer ends of the cylinders and the cam flats, and the cylinder block and the cam flats rotate unitarily but eccentrically. In one embodiment, bridle rings hold the pistons on the cam flats. In another embodiment, springs react between the closed cylinder ends and the outer ends of the pistons to hold the pistons on the cam flats.

13 Claims, 10 Drawing Figures

ROTARY CYLINDER ENGINES WITH PISTONS HAVING BALANCED LOADS

BACKGROUND OF THE INVENTION

1. Field of the Invention

This invention relates generally to fluid displacement devices such as rotary cylinder engines, and more particularly to improvements in rotary engines of the radial piston or plunger type commonly referred to as air motors and air pumps, which improvements provide for balanced radially outward and inward loads on the piston or plunger. For convenience of description, reference hereinafter will be made mainly to air motors.

2. Description of the Prior Art

The following is a list of U.S. patents of interest in the general field of this invention: U.S. Pat. Nos. 3,943,826; 3,777,624; 4,033,239; 3,270,685; 2,347,363; 3,199,460; 4,165,677; and my recently issued U.S. Pat. No. 4,413,486.

None of the above patent are relevant to the instant invention as claimed. No representation is made or intended that the prior art search was complete or that no better art than that listed above is available.

In recent years, many types and configurations of rotating engines have been developed in an attempt to evolve devices having reduced friction, long life, efficient operation and which operate quietly.

The present invention is directed to providing a novel method of mounting a radially movable piston or plunger in combination with a rotating cylinder block and a rotating eccentric to arrive at a device which will solve the aforesaid problems; the piston having a radial opening therethrough allowing pressure to pass through the piston so that the actual working pressure is between the closed outer end of the cylinders in the cylinder block and the eccentric and a substantial balance of radial pressure exists on the pistons.

Above-mentioned U.S. Pat. No. 3,943,826 shows pistons having a radial opening therethrough to supply balancing force on the pistons. However the bearing or cylinder block does not rotate nor do the pistons rotate with the rotating eccentric and the required translatory movement of the pistons takes place between the outer end of the piston and flats formed on the stationary housing; with the working pressure being between the stationary housing and the rotating eccentric. This requires an accurate fit between the outer ends of the pistons and the stationary housing to prevent pressure loss as well as a very accurate fit between the bearing block and the eccentric, which rotate relatively, to prevent pressure loss.

U.S. Pat. No. 3,777,624 shows pistons with bores extending therethrough to balance the pressure on opposed ends of the pistons, a cylindrical rotor having internal flats upon which the pistons slideably seal and a cylinder block reciprocally mounting the piston. It should be noted that the rotor, pistons and block rotate about a dead shaft which gives high inertial loads and a large rotating mass; with nothing surrounding the rotor to protect anyone in the vicinity of the device. The device of this patent also requires complex rotary sealing. Other of the above-mentioned patents show passage means in the pistons, but have features over which the features of the present invention are far superior. My patent 4,413,486 shows pistons reacting against a square cam on a shaft rotatably mounted eccentrically relative to a cylinder block. However, the piston reacts against a square cam to cause the shaft rotation whereas in the present invention, the piston is provided with a radial opening therethrough so that pressure flows through the piston and reacts against the closed outer end of the cylinder block and the square cam to cause shaft rotation.

SUMMARY OF THE INVENTION

A stationary motor housing having a cylindrical bore is mounted on a stationary shaft with the housing surrounding the inner end of the shaft and the shaft being mounted eccentrically relative to the axial center line of the housing bore. Rotatably mounted on the inner end of the stationary shaft is an output shaft which extends from the housing oppositely relative to the stationary shaft and is rotatable relative to the housing. Drivingly secured to the inner end of the output shaft and rotatably mounted about the inner end of the stationary shaft, is a cam which is square when viewed in transverse cross section. The square cam rotates unitarily with the output shaft and is disposed in a central bore of a rotating cylinder block; the cylinder block being mounted for rotation in the stationary housing about an axis which is coaxial with the housing bore and eccentric relative to the axis of the input and output shafts.

In a first embodiment, the cylinder block has two pairs of diametrically opposed radially extending cylinders therein; with each cylinder extending generally perpendicular to an adjacent cam face on the adjacent square cam. The outer end of each cylinder is sealed with a plate thereover secured to the cylinder block. In another embodiment, the cylinders are not diametrically opposed, but are advanced from a diametrically opposed relationship to give an increase in mechanical advantage.

In the first embodiment, a piston or plunger is received in each of said cylinders and extends radially inwardly of the cylinder block. The radially inner end of each of said pistons terminates in an enlarged square shoulder; the inner end of such shoulder abutting the adjoining square cam in a sliding and sealing relationship. A pair of bridle rings are provided, with one bridle ring secured to each pair of opposed pistons to control the spaced relationship thereof as discussed regarding bridle rings in my U.S. Pat. No. 4,413,486, and maintain the inner surface of the pistons in engagement with the square cam. In another embodiment, bridle rings are not used, but, instead, springs are disposed between the outer ends of the pistons and the plates at the outer ends of the cylinders to bias the pistons inwardly into constant engagement with the square cam.

Each of the pistons has a radially extending central opening passing therethrough, and the inner surface of each square shoulder or each piston which abuttingly engages the square cam is provided with a concave depression which has an effective area such that the fluid pressure at the opposed ends of the pistons, which pressure has flowed through the piston's central opening, imposes substantially balanced pressure loads on the ends of said pistons.

Inlet and outlet air passages are formed in the stationary shaft, while two pair of opposed passages are formed in the square cam. The cam passages upon rotation are alternately brought into confluent relationship with the inlet and outlet air passages of the stationary shaft. The cam air passages extend outwardly to the flat surfaces of the cam and sequentially charge and then discharge the cylinders in the block and the opening in the pistons; the reactive or turning force on the output shaft being generated by the compression of the pressure fluid between the end plate and the square cams, with the piston imposing no driving load on the cam but functioning primarily as a plunger which provides a passageway to the outer end of the cylinder and also insures that the cylinder block rotates unitarily but eccentrically with respect to the output shaft.

An object of this invention is to provide a rotary cylinder engine which provides for balanced radially outward and inward loads on the pistons.

Another object is to provide such an engine with a stationary housing wherein the pressure fluid reacts between an eccentric shaft and the closed outer ends of the cylinders in a rotating cylinder block.

The invention accordingly comprises the combination of elements, features of construction, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
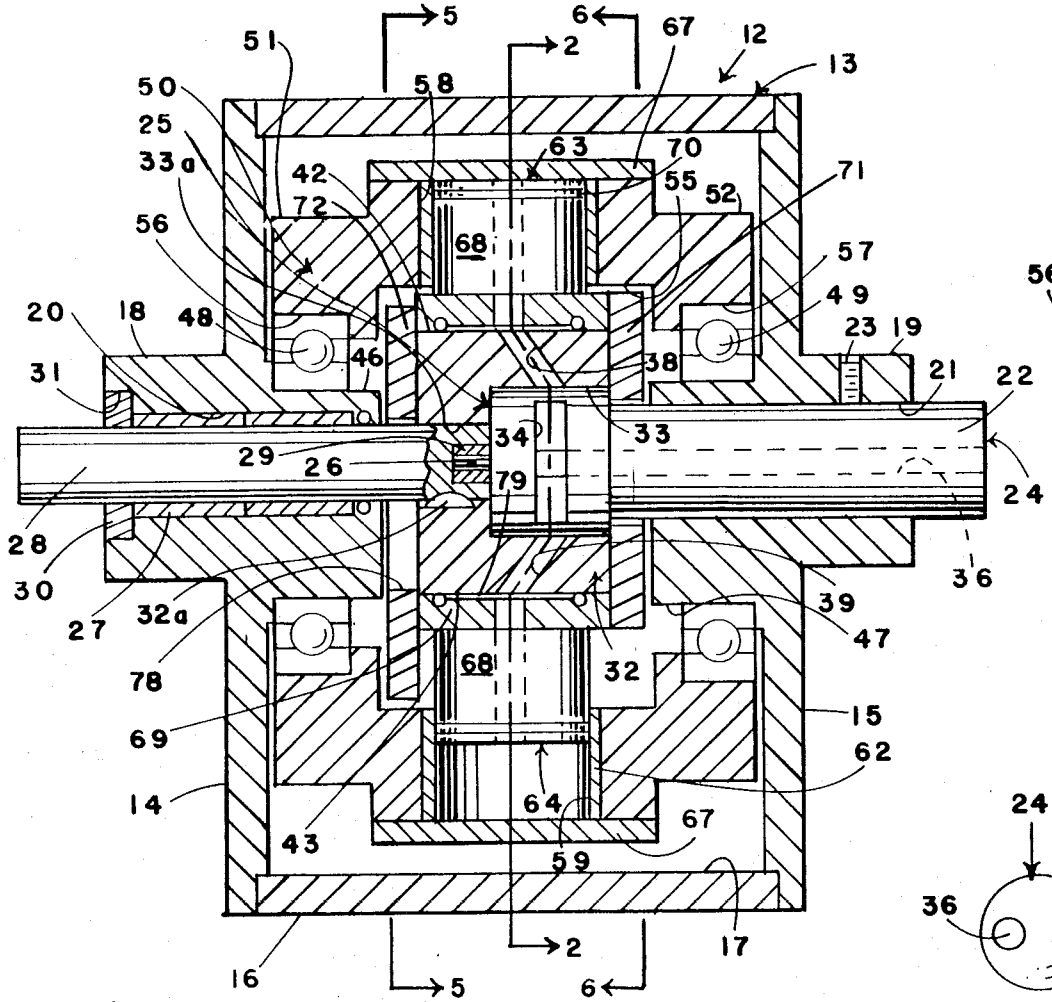
FIG. 1 is a longitudinal cross sectional view of this invention with certain parts shown in elevation.

Referring now to FIGS. 1–7, a rotating cylinder engine 12 has a stationary three piece housing 13 made up of a left 14 and a right 15 annular end plate, respectively, suitably secured to an intermediate annular member 16 having a cylindrical bore 17. The end plates 14 and 15 are conventionally suitably secured to the annular member 16 as by a plurality of circumferentially spaced bolts (not shown). The end plates 14 and 15 have, respectively, an annular boss 18 and 19 projecting axially outwardly therefrom, which bosses are disposed on the end plates at a location, which, when viewed in FIG. 1, is located above the center line of the bore 17.

The bosses 18 and 19 have a centrally located axially extending bore therein; the boss 18 having a bore 20 and the boss 19 having a bore 21. A stationary shaft 22 is disposed in the bore 21 and secured by a set screw 23 mounted in the boss 19. The shaft 22 has a right end 24 which projects from the right end of the boss 19 and an enlarged cylindrical left end 25 which is dispoed inwardly of the housing 13 and terminates just to the left of the center of the housing. Projecting to the left from the enlarged left end 25 is a pilot 26 coaxial with the shaft 22.

Located in the bore 20 of the boss 18 is a bushing 27 which rotatably mounts an output shaft 28; the left end of the output shaft projecting to the left of the housing 13, while the right end of the output shaft projects into the housing 13 coaxially with the shaft 22, and terminates at its right end immediately to the left of the enlarged end of the stationary shaft 24; the right end of the shaft 28 containing a bearing bushing 29 which rotatably mounts the pilot 26 on the left end of the shaft 22. A seal 30 is pressed into a counterbore 31 at the outer end of the bore 20 which sealingly engages the shaft 28.

Figure 3:
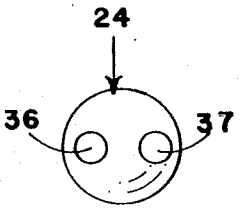
FIG. 3 is a view of the end of the stationary shaft of FIG. 1 when viewed from the right.
Figure 2:
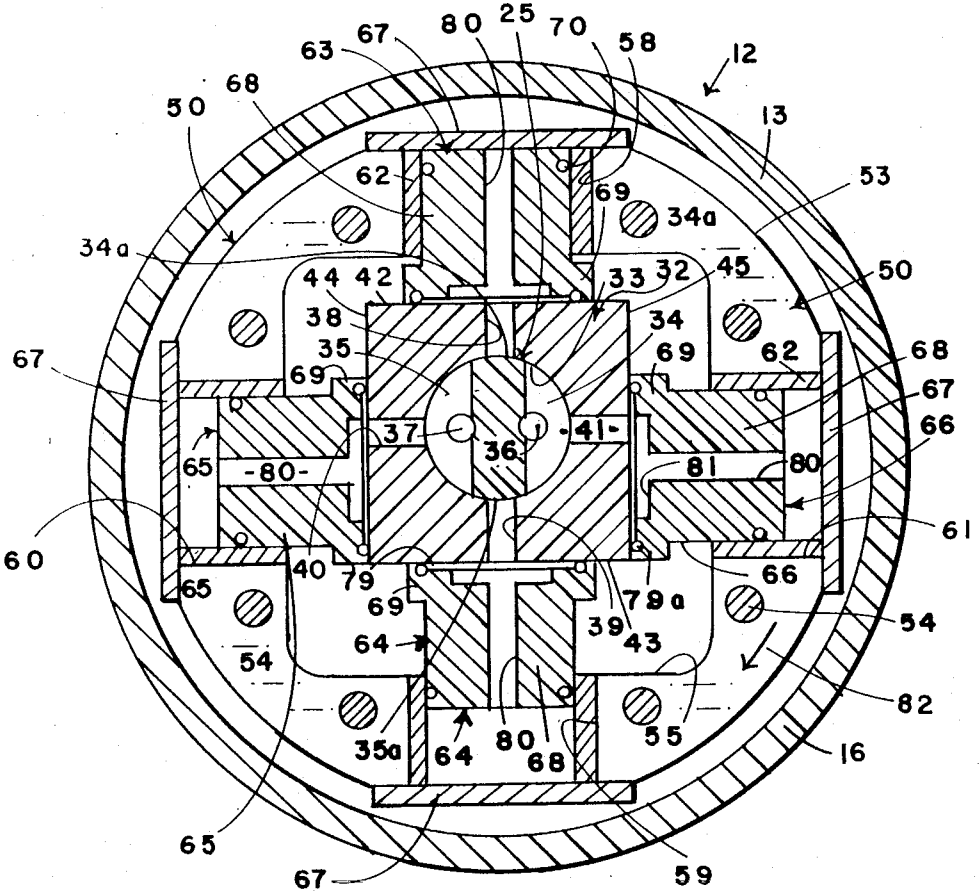
FIG. 2 is a cross sectional view taken substantially on the line 2—2 of FIG. 1 with the bridle rings eliminated for added clarity.

A cam member 32 which is rectangular in longitudinal cross section as seen in FIG. 1 and square in transverse cross section as seen in FIG. 2, has an enlarged bore 33 at the right end thereof, as seen in FIG. 1, which enlarged bore rotatably receives in a close piloting fit, the enlarged left cylindrical end 25 of the shaft 22. The enlarged cylindrical end 25 of shaft 22, has a pair of diametrically opposed slots, as seen in FIG. 2, the left slot is shown at 35 and the right slot is shown at 34 (the slot as seen in FIG. 1 is the slot 34) which slots are respectively confluent with axially extending openings 36 and 37 formed in the stationary shaft 22, the openings 36 and 37 can be seen in FIGS. 1, 2 and 3, with the opening 36 as seen in FIG. 3 being the left opening. As seen in FIG. 2, the upper cylindrical land area **34*a* between the slots 34 and 35 is operative to sealingly engage the bore 33 as is the lower cylindrical land area 35*a* in sealing engagement with the bore 33**.

The square cam 32, as seen in FIG. 1, has a bore **33*a* formed in the left end thereof coaxially with the bore 33 in the cam 32, which bore 33*a* receives the right end of the shaft 28, where they are keyed together for unitary rotation by a conventional key 32*a***.

The square cam 32 also has four passageways formed therein, as seen in FIG. 2, the passageways 38 and 39 being upward and downward as seen in FIG. 2 and the passageways 40 and 41 being to the left and to the right, respectively, as seen in FIG. 2. As seen in FIG. 1, the slot 34, and the slot 35 directly behind the slot 34, are formed slightly to the right of the outer end of the enlarged left end 25 of the stationary shaft 24, and, therefore, slightly to the right of the center of the square cam member 32. The passageways 38, 39, 40 and 41, as exemplified by the passageways 38 and 39 in FIG. 1, have their inner end positioned so they are co-planar with the slots 34 and 35, and then slant toward the left to emerge from the square cam 32 at a location axially intermediate its ends as seen in FIG. 1, and circumferentially intermediate the ends of the cam flats as seen in FIG. 2; the upper and lower flats being designated 42 and 43 respectively and the left and the right flat being designated 44 and 45 respectively.

A pair of annular bosses; left boss 46 and right boss 47 respectively projecting radially inwardly of the housing 13 from the left end plate 14 and the right end plate 15 respectively are formed coaxially with the bore 17 in the housing 13, while being eccentrically located with respect to the axes of the shafts 24 and 28. As seen in FIG. 1, the axis of the bores in the bosses 18 and 20 being located above the axes of the boss 46 and the boss 47.

A roller bearing assembly 48 is mounted on the boss 46 and a roller bearing assembly 49 is mounted on the boss 47. Mounted for rotation in the housing 13 on the bearings 48 and 49 is a cylindrical block 50. The cylindrical block 50 has a pair of outer cylindrical surfaces 51 and 52 and the central portion thereof is substantially cylindrical as seen at 53 in FIG. 2.

Figure 4:
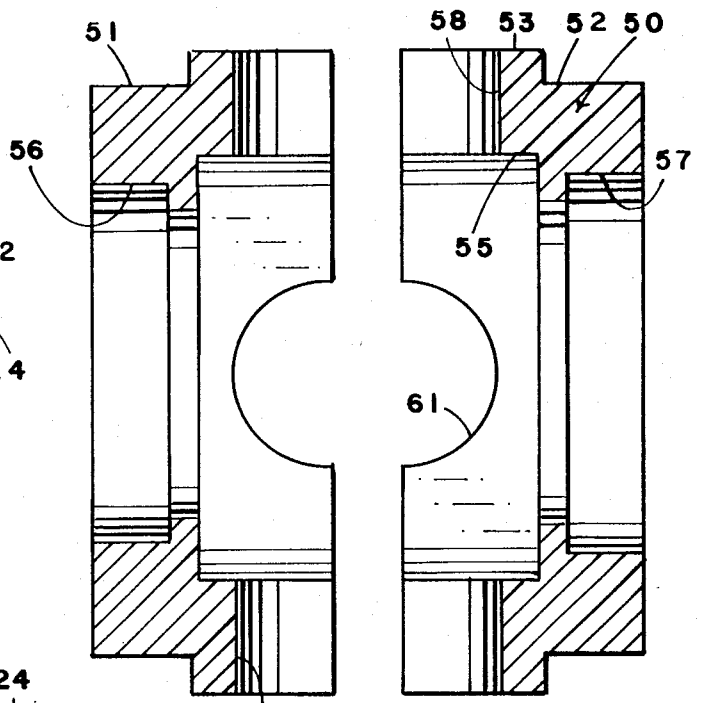
FIG. 4 is a longitudinal cross sectional view of the rotating cylinder block of FIG. 1 with all surrounding parts deleted for added clarity.

The cylinder block 50 is of two piece construction as seen in FIG. 4, with the two lateral sides seen in FIG. 4 being suitably secured together as by a plurality of axially extending bolts 54 as seen in FIG. 2.

The cylinder block 50 has a central axially extending bore 55 which is substantially rectangular in cross section as viewed in FIG. 2, in which is disposed the cam member 32 as well as other items hereinafter described. A left 56 and right 57 counterbore are respectively rotatably mounted on the bearings 48 and 49. The cylinder block 50 also has four radially extending cylinders as seen in FIGS. 1, 2 and 3, an upper cylinder 58, a lower cylinder 59, a left cylinder 60 and a right cylinder 61. Each cylinder 58–61 has therein a cylinder sleeve 62, which sleeves, when the two pieces of the cylinder block as seen in FIG. 4, are bolted securely together as seen in FIGS. 1 and 2, securely hold the cylinder sleeves in the cylinders 58–61. Secured to the cylinder block 50 and covering the outer end of each cylinder and cylinder sleeve therein is a flat plate 67; such securement being by conventional means as by a plurality of bolts (not shown) and such securement being tight enough to form a pressure tight seal between the plate and the outer end of the cylinder and cylinder sleeve.

Slideably received in each of the cylinder sleeves 62 is a piston, the piston 63 being the upper, the piston 64 being the lower, and, as seen in FIG. 2, the piston 65 being the left and the piston 66 being the right.

As seen in FIGS. 1 and 2, each of the pistons 63–66 has a radially outer cylindrical end 68 integrally formed on a flat square base 69; the cylindrical portion 68 each having a sealing ring 70 in the periphery thereof adjacent the outer end thereof to make a pressure tight seal with the associated cylinder sleeve 62 and preferably made of a low friction plastic material such as Teflon.

As seen in FIG. 1, the square base 69 of each piston 63–66 engages an associated cam flat 42–45 of the cam member 32, with the axial length of the square base being substantially the same as the axial length of the cam flat 42–45. As seen in FIG. 2, the square bases 69 in the transverse direction are shorter than the associated cam flats 42–45 of the cam member 32, so that as the piston moves relative to the cam flat to its lowermost position as seen regarding the right and left pistons 65 and 66, the lower end of the square base will coincide with the lower end of the associated cam flat 42–45.

Figure 6:
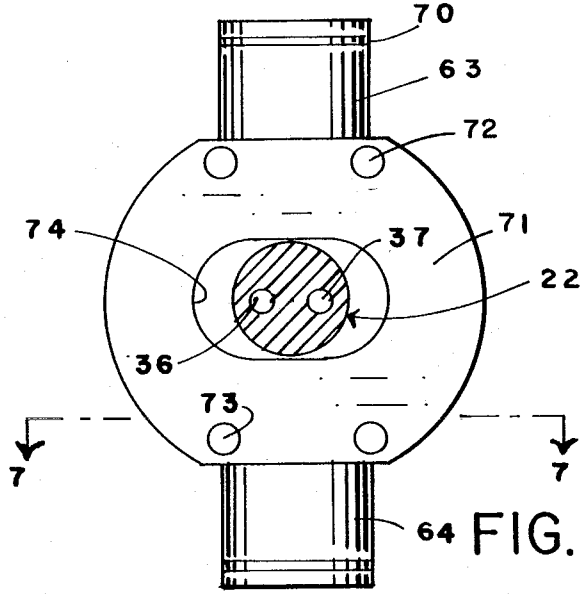
FIG. 6 is a view taken along the line 6—6 in FIG. 1 but merely showing the right side of the right bridle ring, the pair of pistons secured thereto and a cross sectional view of the stationary shaft.

As seen in FIGS. 1 and 6, the bases of the upper and lower pistons 63 and 64 are secured together by a bridle ring 71; a pair of bolts 72 securing the ring 71 to the base of the piston 63 and a pair of bolts 73 securing the ring 71 to the base of the piston 64. As seen in FIG. 1, the bridle ring 71 is positioned immediately to the right of the cam member 32 and is disposed within the central bore 55 of the cylinder block 50. The ring 71 has a central opening 74, which, as seen in FIG. 6, is laterally elongated; and in which opening is received the shaft 22. When the pistons 63 and 64 rotate so that they are horizontal (that is to the positions of the pistons 65 and 66), the pistons 63 and 64 and the bridle ring will move relative to the shaft 22 and the opening 74 will accommodate such movement. The ring 71 is sized such and secured to the piston 63 and 64 so that the radial inner end of the pistons are held in firm engagement with the associated cam flats 42 and 43 respectively.

Figure 5:
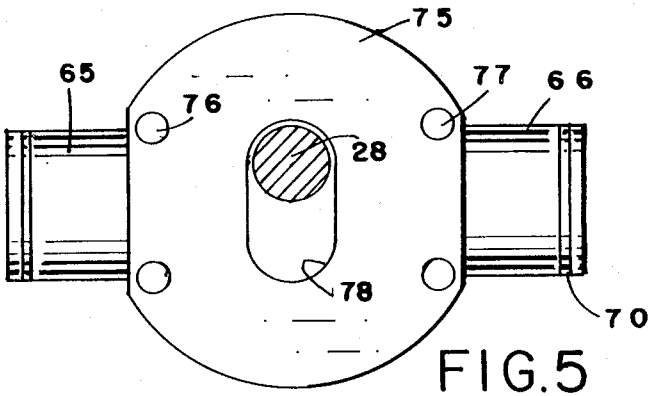
FIG. 5 is a view taken along the line 5—5 in FIG. 1 but merely showing the left side of the left bridle ring, the pair of pistons secured thereto and a cross sectional view of the output shaft which passes through the left bridle ring.

As seen in FIGS. 1 and 5, the bases of the left and right pistons 65 and 66 are secured together by the bridle ring 75, a pair of bolts 76 securing the ring 75 to the base of piston 65 and a pair of bolts 77 securing the ring to the base of the piston 66. The ring 75 is sized such and secured to the pistons 63 and 64 so that they are held in firm engagement with the associated cam flats 44 and 45, respectively. As seen in FIG. 1, the bridle ring 75 is positioned immediately to the left of the cam member 32 and is disposed within the central bore 55 of the cylinder block 50. The ring 75 has a central opening 78 which central opening 78, as seen in FIGS. 1 and 5, is vertically elongated, and in which opening is received the shaft 28. As seen in FIG. 5, the shaft 28 has moved to the top of the opening 78. When the pistons 65 and 66 move to the vertical position, the shaft 28 will be in the center of the slot 78, and when the left and right pistons 65 and 66 rotate one hundred eighty (180) degrees so that the left piston becomes the right and the right the left, the shaft will move to the opposite end of the slot from that shown in FIG. 5. Similarly, movement within the slot 74 will take place upon rotation of the pistons 63 and 64.

Figure 7:
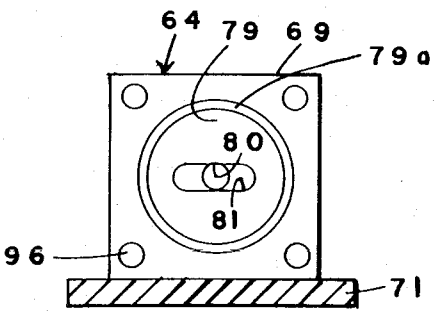
FIG. 7 is a bottom view of one of the pistons taken along the line 7—7 in FIG. 6 showing the bottom of the piston and its adjacent bridle ring.

The square base 69 of each piston 63–66 has an annular concave depression 79 therein bounded at its periphery by an annular sealing ring 79*a* made of a suitable low friction plastic sealing material such as Teflon. A central bore 80, which extends radially with respect to the engine, extends for the length of each piston 63–66 and joins the depression 79 in the piston to the radially outer end of the piston. Within each of the depressions 79, as more clearly seen in FIGS. 2 and 7, is an elongated slot 81 which provides for more rapid movement of air flow between the central bore 80 and the bottom of the base 69 of the pistons 63–66. As seen in FIGS. 1 and 2, the annular depression 79 and the elongated slot 81 are confluent with the adjoining passageways 38–41 in the cam member 32. As seen in FIG. 2, the slots 81 are elongated in the transverse direction so that as the pistons 63–66 move relative to the cam flats 42–45, the slots 81 will remmain confluent with the passageways 38–41.

The bottoms of the piston base, as seen in FIG. 7, is provided with four Teflon buttons 96 disposed therein outwardly of the sealing ring 79*a*, which buttons serve to insure reduced friction and prevent the seal 79*a* from being compressed excessively.

The central bores 80 in the pistons 63–66 are present to allow fluid pressure which enters at the base of the pistons to flow directly through the pistons and thereby react against the plate 67 secured to the outer end of the associated cylinder 58–61 in the cylinder block 50. The size of the annular depressions 79 in the pistons 63–66 is selected relative to the size of the outer ends of the pistons so that the pressure on the opposed ends of the pistons is substantially equal. Accordingly, pressure within a given cylinder reacts between the end plate at the outer end of such cylinder and the cam flat which is directly associated with such cylinder. Since the pistons are equally loaded at either end they do not provide the driving force but serve two functions, first, to supply a sealed conduit from the cam flat to the outer end of the cylinder, and secondly, to insure that the cylinder block 50 rotates unitarily with the cam member, which is keyed by the key 32*a* for unitary rotation to the output shaft 28. Since there is no load on the pistons within the cylinders, there is little friction between the piston and the corresponding flat on the cam member.

Assuming the opening 36 in the shaft 24 is the inlet port and the opening 37 is the outlet port, pressure fluid, such as air pressure, enters opening 36, then to slot 34, passageway 41 in cam member 32, then to the annular depression 79 and slot 81 in the right piston 66, through the bore 80 in piston 66 and reacts against the end plate 67 and the inner wall of the bushing 62 of the cylinder 61; the force is then effectively between the end plate 67 and the cam flat 45 which lies within the confines of the sealing ring 79*a*. Because of the eccentric relationship between the cylinder block 50 and the cam member 32, cam member 32 will be urged to rotate in the direction of the arrow 82 shown in FIG. 2. The cylinder block will rotate with the cam member 32 and the throw of the pistons 63–66 will be dictated by the amount of eccentricity between the output shaft and the cylinder block.

When the piston reaches the downward position of 64, lower land area 35*a* blocks passageway 39 and neither charging nor exhausting of the cylinder 59 takes place. When the piston rotates to the leftward position occupied by the piston 65 in FIG. 2, pressure within the cylinder will be exhausted through the bore 80, the slot 81 and annular depression 79, through the associated passageway 38–41 in the cam member 32, and then through the slots 35 and opening 37 in the shaft 24. When the piston reaches the upper position of piston 63, the upper land area blocks passageway 38 and neither charging nor exhausting of the cylinder 58 takes place. It is understood that for the purpose of this paragraph, passageways 38 and 39 have been chosen for illustrative purposes only as the upper and lower passageways, for as the cam member 32 rotates passageways 38–41 rotate between positions.

With this embodiment, if the opening 37 is made the inlet port and the opening 36 the exhaust port, rotation will be in the opposite direction.

Figure 9:
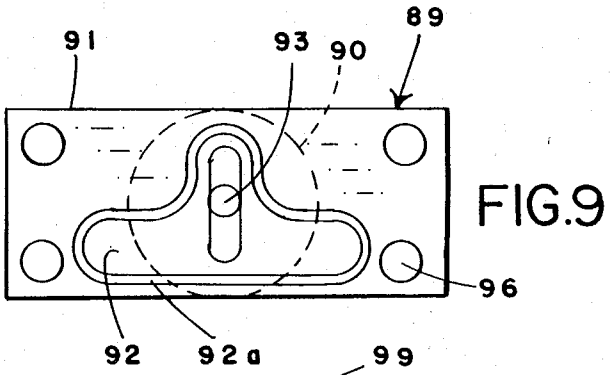
FIG. 9 is a view taken along the line 9—9 in FIG. 8 showing the bottom of the piston.
Figure 8:
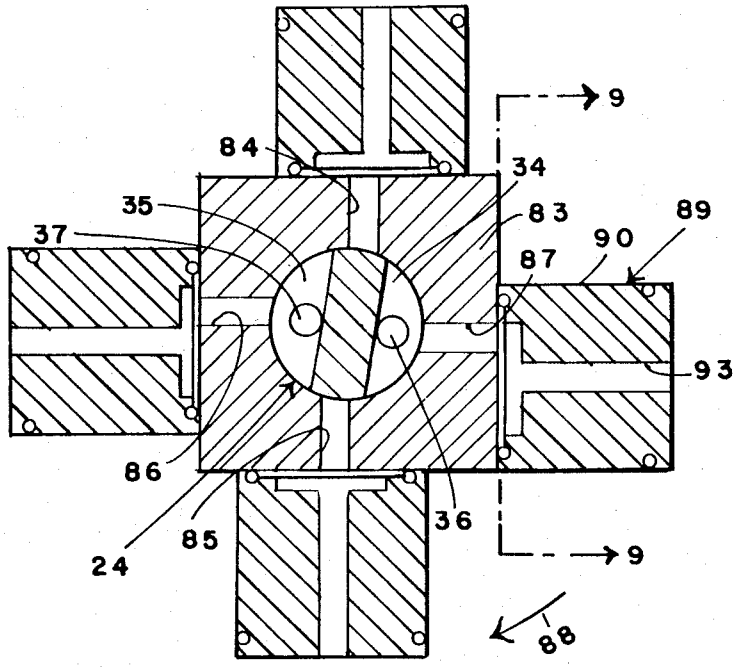
FIG. 8 is a longitudinal cross sectional taken in the same manner as FIG. 2 of another embodiment of this invention, but merely showing the eccentric shaft, the stationary shaft, and the four pistons associated therewith.

Referring now to FIGS. 8 and 9 wherein a modified embodiment of this invention is disclosed, the pistons are set forwardly relative to the associated cam surface in the direction of rotation to give a greater mechanical advantage. The majority of the elements of this structure are the same as they are in FIGS. 1, 2 and 3. The differences will be hereinafter described. Rotation of this embodiment can only be in the direction of the arrow 88.

A cam member 83 is provided with four passageways 84, 85, 86 and 87, however, instead of being disposed radially as they were in FIG. 2 they are advanced in the direction of rotation, as indicated by the arrow 88, but lie parallel to the radial openings of the embodiment of FIG. 2. The pistons, as illustrated by the right hand piston 89 in FIG. 8, has a cylindrical portion 90 formed integrally with a rectangular base 91; which base is seen clearly in FIG. 9 from the bottom thereof. The base 91 and the cam member 83 are elongated in the direction of the axis of the shaft 22. As seen in FIG. 9, the concave depression 92 in the bottom of the piston is enlarged in size in the rotational or forward direction relative to the bore 93 in the piston 89 and reduced in size in the rearward direction relative to the bore 93, so as to have an inverted "T" configuration. This provides a larger reactive area toward the leading end of the cam member. The depression 92 is bounded by a sealing ring 92*a*.

As noted with the top and bottom pistons 94 and 95, they do not return to the central portion in the dead top and dead bottom positions relative to the cam member as did the pistons of FIG. 2, since they have been advanced slightly. These pistons do not extend radially relative to the axis of the cylinder block (not shown) nor do the cylinders (not shown) in the cylinder block extend radially, but are advanced in the direction of rotation and lie parallel to the radial direction of the first embodiment. The pistons 89 also have four teflon buttons 96 in the base thereof to reduce friction.

Figure 10:
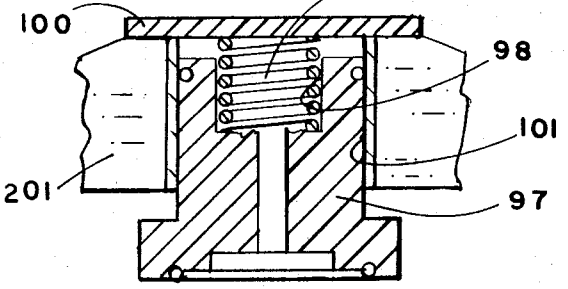
FIG. 10 is a cross sectional taken similarly to FIG. 2, of another embodiment of this invention, but merely showing a single piston, the adjacent fragmentary part of the cylinder block, and a spring associated with the piston.

In FIG. 10, another embodiment of this invention is shown which does not use bridle rings as did the embodiments of FIGS. 1–7. Instead, the outer end of the piston 97 is provided with a counter bore 98 which receives the inner end of a coiled compression spring 99 which is compressed between a flat plate 100 suitably sealingly secured to the outer end of the cylinder 101 of the cylinder block 102. The spring 99 biases the piston 97 so that the inner end thereof constantly engages the associated cam flat on the cam member.

Piston 89 of FIG. 9 can be provided with bridle rings as is the embodiment of FIGS. 1–7 or with the springs of the embodiment of FIG. 10.

It will thus be seen that the objects set forth above, and those made apparent by the foregoing description, are efficiently attained, and since certain changes may be made in the above construction without departing from the scope of the invention, it is intended that all matters contained in the foregoing description, or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A rotary cylinder engine, comprising, a non-rotatable housing, a shaft rotatably mounted in said housing, and extending from and rotatable relative to said housing, a cylinder block rotatably mounted in said housing, said cylinder block having a central opening therein receiving said shaft with the axis of rotation of said shaft being eccentric with respect to the axis of rotation of said cylinder block, a plurality of cylinders formed substantially radially in said cylinder block with the outer end of said cylinders being sealingly closed, a piston slideably disposed in each of said cylinders with said piston having a fluid passageway extending therethrough from the inner end of said piston and open at the end thereof adjacent the sealed end of said cylinder, cam means with a plurality of flat cam surfaces thereon, with one cam surface being disposed radially inwardly of each of said pistons and being slideably and sealingly engaged by the radially inner end of said piston it is radially inwardly of, means connecting said cam means for unitary rotation with said shaft, means holding the inner ends of said pistons sealingly against said cam surfaces, means including said piston means and said cam means for rotating said cylinder block and said shaft unitarily, a cam fluid passage means in each of said cam surfaces confluent with the fluid passageway in the piston engaging said cam surface, a pair of fluid passage means extending into said housing with one being a fluid source and one being an exhaust means, said source means and said exhaust means being alternately confluently connected to said cam fluid passage means in said cam surfaces, said inner end of each of said pistons has a centrally formed depression formed therein substantially equal in area to the area of the outer end of said piston with said depression being formed confluent with the fluid passage on said piston, the inner end of said piston includes a sealing member therein sealingly engaging the cam surface disposed radially inwardly of said piston, and said inner end of said piston includes friction reducing means disposed outwardly of said sealing member for reducing friction between said piston and said cam surface and for preventing excess loads on said sealing member.

2. A rotary cylinder engine according to claim 1, wherein said housing means includes stationary mounting means mounting the end of said shaft for rotation within said housing, with a portion of said mounting means being accessible from outside said housing means, said cam means is rotatably mounted on said stationary means, said source means and said exhaust means each include a passageway formed in said stationary mounting means and extending from outside said housing to the location on said stationary means which rotatably mounts said cam means, said cam fluid passageway means becoming confluent alternately with said source means and said exhaust means upon relative rotation of said of said cam means and said stationary means, and means spacing said source means and said exhaust means for blocking said cam fluid passage means when the latter are disposed intermediate said source means and said exhaust means.

3. A rotary cylinder engine according to claim 1, wherein said cylinders are coplanar and are four in number, with said cylinders being disposed in paired relationship with one cylinder of each pair being substantially diametrically opposed to the other cylinder of such pair, said means holding the inner ends of a pair of diametrically opposed pistons sealingly against said cam surfaces is a bridle ring means secured to the pair of diametrically opposed pistons, each of said bridle rings having an axially extending longitudinally elongated slot formed therein in a direction transverse to the axis of pistons secured to such ring.

4. A rotary cylinder engine according to claim 1, wherein said means holding the inner ends of each of said pistons sealingly against said cam surfaces is a spring means compressed between the outer end of said cylinder and said piston for biasing said piston radially inwardly.

5. A rotary cylinder engine according to claim 1, wherein said friction reducing means includes a plurality of spaced plastic buttons.

6. A rotary cylinder engine according to claim 1, wherein said cylinders formed in said cylinder block are advanced circumferentially from the radial direction in the direction of rotation of said cylinder block while remaining perpendicular to the cam surface associated with said cylinder and said inner end of each of said pistons has a concave depression formed therein substantially equal in area to the area of the outer end of said pistons with said depression being formed confluent with the fluid passage in said pistons, with respect to the central radial axis of the pistons said depression being enlarged in the direction of rotation of said cam whereby the fluid compressed between the closed cylinder end and said cam surface acts on said cam surface with a mechanical advantage over what would be the case if it reacted centrally on said cam surfaces.

7. A rotary cylinder engine according to claim 1, wherein said piston has a transversely extending slot formed within the depression therein, which slot is confluent with the cam passage means and the fluid passageway in the associated piston to provide less restriction on the flow of pressure fluid between said cam passage means and said fluid passageway.

8. A rotary cylinder engine according to claim 1, wherein said piston has a transversely extending slot formed within the depression therein, which slot is confluent with the cam passage means and the fluid passageway in the associated piston to provide less restriction on the flow of pressure fluid between said cam passage means and said fluid passageway.

9. A rotary cylinder engine, comprising, a non-rotatable housing having a housing bore, said housing mounting a stationary means extending inwardly of the housing and terminating therewithin and being disposed eccentrically with respect to the axis of said housing bore, a shaft rotatably mounted on said stationary means and coaxial therewith and extending from and rotatable relative to said housing, a cylinder block rotatably mounted in said housing and coaxial with said housing bore with the axis of rotation of said shaft being eccentric with respect to the axis of rotation of said cylinder block, said cylinder block having a central opening therein receiving said shaft, a plurality of cylinders formed substantially radially in said cylinder block with the outer end of said cylinders being sealingly enclosed, a piston slideably disposed in each of said cylinders with each of said pistons having a fluid passageway extending therethrough from the inner end thereof and open at the end thereof adjacent the sealed end of said cylinder, cam means with a plurality of flat cam surfaces thereon, with one cam surface being disposed radially inwardly of each of said pistons and being slideably and sealingly engaged by the radially inner end of said piston it is radially inwardly of, means connecting said cam means for unitary rotation with said shaft, means holding the inner ends of said pistons sealingly against said cam surfaces, means including said piston means and said cam means for rotating said cylinder block and said shaft unitarily, a cam fluid passage means in each of said cam surfaces confluent with the opening in the piston engaging said cam surface, said cam means being rotatably mounted on said stationary means, a pair of fluid passage means extending into said housing through said stationary means with one passage means being a fluid source and one being an exhaust means, said source means and exhaust means being alternately confluently connected to said cam fluid passage means in said cam surfaces, the portion of said stationary means mounting said cam means is cylindrical in cross section and has a pair of diametrically opposed chordally extending slots therein with the slots being separated by segments of said cylindrical surface, the portion of said cam means mounted on said stationary means is a cylindrical bore, said source means and said exhaust means are passages formed in said stationary means and lead from a portion of said stationary means external of the housing to a position wherein said source means is confluent with the other of said slots, and the cam fluid passage means in each of said cam surfaces extends from said cam surface radially inwardly to the cylindrical bore in said cam means at a location where such can alternately become confluent with said slots upon relative rotation, said inner end of each of said pistons has a centrally formed depression therein substantially equal in area to the area of the outer end of said piston, with said depression being formed confluent with the fluid passage on said piston, said cylinders formed in said cylinder block are advanced circumferentially from the radial direction in the direction of rotation of said cylinder block while remaining perpendicular to the cam surface associated with said cylinder and said inner end of each of said pistons has a concave depression formed therein substantially equal in area to the area of the outer end of said pistons with said depression being formed confluent with the fluid passage in said pistons, with respect to the central radial axis of the pistons, said depression being enlarged in the direction of rotation of said cam whereby the fluid compressed between the closed cylinder end and said cam surface acts on said cam surface with a mechanical advantage over what would be the case if it reacted centrally on said cam surfaces.

10. A rotary cylinder engine according to claim 9, wherein the inner end of said piston includes a sealing member inserted therein and sealingly engaging the cam surface disposed radially inwardly of said pistons.

11. A rotary cylinder engine according to claim 9, wherein said inner end of said piston includes a friction reducing means disposed outwardly of said sealing member for reducing friction between said piston and said cam surface and for preventing excess loads on said sealing member.

12. A rotary cylinder engine according to claim 9, wherein said cylinders are coplanar and are four in number, with said cylinders being disposed in paired relationship with one cylinder of each pair being substantially diametrically opposed to the other cylinder of such pair, said means holding the inner ends of a pair of diametrically opposed pistons sealingly against said cam surfaces is a bridle ring means secured to the pair of diametrically opposed pistons, each of said bridle rings having an axially extending longitudinally elongated slot formed therein in a direction transverse to the axis of pistons secured to such ring.

13. A rotary cylinder engine according to claim 9, wherein said means holding the inner ends of each of said pistons sealingly against said cam surfaces is a spring means compressed between the outer end of said cylinder and said piston for biasing said piston radially inwardly.

* * * * *